US006945825B2

(12) United States Patent
Aramoto et al.

(10) Patent No.: US 6,945,825 B2
(45) Date of Patent: Sep. 20, 2005

(54) PAIR OF IRREVERSIBLE COMPLEMENTARY CONNECTORS

(75) Inventors: Kiyoshi Aramoto, Higashiosaka (JP); Keiji Kuroda, Amagasaki (JP)

(73) Assignee: J.S.T. Mfg. Co, LTD, Osaka (JP)

( * ) Notice: Subject to any disclaimer, the term of this patent is extended or adjusted under 35 U.S.C. 154(b) by 0 days.

(21) Appl. No.: 10/640,377

(22) Filed: Aug. 14, 2003

(65) Prior Publication Data

US 2004/0043669 A1 Mar. 4, 2004

(30) Foreign Application Priority Data

Sep. 2, 2002 (JP) ..... JP2002-256697

(51) Int. Cl.[7] ..... H01R 13/64
(52) U.S. Cl. ..... 439/680; 439/677; 439/358
(58) Field of Search ..... 439/680, 677, 439/674, 638, 350–358

(56) References Cited

U.S. PATENT DOCUMENTS 4,376,565 A * 3/1983 Bird et al. ..... 439/681
5,238,413 A * 8/1993 McCaffrey et al. ..... 439/79
5,277,627 A * 1/1994 Matsuzaki ..... 439/677
5,397,247 A * 3/1995 Aoki et al. ..... 439/496
5,486,117 A * 1/1996 Chang ..... 439/357
5,816,842 A * 10/1998 Thantrakul et al. ..... 439/374
5,865,651 A * 2/1999 Dague et al. ..... 439/680
5,897,386 A * 4/1999 Baxter et al. ..... 439/79
6,010,359 A * 1/2000 Etters et al. ..... 439/496
6,146,190 A * 11/2000 Fuerst et al. ..... 439/496
6,565,386 B1 * 5/2003 Yoneyama et al. ..... 439/607
2003/0008566 A1 * 1/2003 Kato et al. ..... 439/638

* cited by examiner

*Primary Examiner*—P. Austin Bradley
*Assistant Examiner*—X. Chung-Trans
(74) *Attorney, Agent, or Firm*—Antonelli, Terry, Stout & Kraus, LLP

(57) ABSTRACT

A pair of irreversible female and male connectors (2,1) fitting one in another have respectively female and male housings (22, 2), and the female housing (22) has a cavity (23) with a front opening so as to fit on the male housing (2) along an insertion direction. The female housing (22) has pin contacts (28) in placed the cavity and partitions (25) formed in it along the direction so as to separate the contacts (28) one from another. Socket contacts (42) engaging the pin contacts are placed in the male housing (2) that has cutouts (6) fitting on the partitions (25), and each partition having opposite sides (35,36) asymmetrical about a cross section center of the partition. Each cutout (6) also has asymmetrical sides (45,46) corresponding to the sides of each partition, such that the connectors are inhibited from engaging one another if one of them is reversed upside down, so that the pair of connectors are unlikely to come into wrong and upside-down connection, thus ensuring a stable and reliable mutual engagement even if they are designed thinner and smaller in size as required for the high-voltage type connectors.

4 Claims, 5 Drawing Sheets

PAIR OF IRREVERSIBLE COMPLEMENTARY CONNECTORS

FIELD OF THE INVENTION

The present invention relates to a pair of irreversible complementary connectors that are particularly of the type adapted for use to conduct high-voltage currents.

PRIOR ART

Generally, the prior art female and male housings of irreversible complementary connectors have engagement faces formed asymmetric up and down so as not to be reversed upside down relative to each other. In an example (as disclosed in the Utility Model Laying-Open Gazette No. 5-41080, pages 6 and 7, FIGS. 5 and 6), the female connector housing has a central cavity and opposite side walls defining between them the cavity. Stepped portions formed in the side walls correspond to mating stepped portions of the male connector housing. These mating portions are likewise formed in side walls of said male housing and between its central cavity, so that those connector housings are made take their correct up-and-down posture relative to each other. However, such housings of the prior art irreversible complementary connectors have been rendered considerably large in size.

On the other hand, the recent notebook type personal computers have liquid crystal displays comprising the so-called back lights. Power source circuits for the back lights need high-voltage type connectors that should be thinner and smaller in size. As compared with the low-voltage type connectors, incorrect or unsure electric connection through the high-voltage connectors will more possibly cause a serious accident. Therefore, prevention of reversed engagement and assurance of reliable and sure engagement of the female and male housings with each other are required in the high-voltage connectors for the purpose of safety.

In another example of the female connector housing (as disclosed in the Patent Laying-Open Gazette No. 2000-165062, pages 3 and 4, FIG. 2), a partition is disposed between an input terminal (such as a pin contact) and an output terminal (such as a pin contact). The former terminal is thus separated and spaced from the latter so that a sufficient linear distance is afforded between them. The partition is offset sideways from the center line of said housing, thereby making its right-hand and left-hand halves asymmetric with respect to each other so as to prevent their reversed mutual engagement.

There is however a certain dimensional limitation such that the partition could neither be made offset far away from the center line, nor be made thick enough. The partition is likely to be deformed or broken if and when the male housing is forcibly inserted into the female housing.

SUMMARY OF THE INVENTION

An object of the present invention made in view of these requirements and problems noted above is to provide a pair of irreversible complementary connectors unlikely to come into mutual wrong and upside down connection. This pair of complementary connectors has to ensure a stable and reliable engagement with each other, even if they are designed thinner and smaller in size as required for the high-voltage type connectors.

In order to achieve this object, a pair of female and male connectors proposed herein and capable of fitting one in another do respectively comprise a female housing and a male housing, such that the female housing has a cavity with a front opening so as to fit on the male housing along an insertion direction thereof. The female housing has a plurality of pin contacts accommodated in the cavity, as well as at least one partition formed therein along the insertion direction so that one of the pin contacts is separated from the other. A plurality of socket contacts engaging with the pin contacts are accommodated in the male housing that has at least one cutout fitting on the at least one partition. Each partition has opposite sides asymmetrical about a cross-sectional center of the partition, and each cutout also has opposite sides formed asymmetrical corresponding to the sides of each partition, such that the connectors are inhibited from engaging one another if one of them is reversed upside down relative to the other.

In a preferable example, one of the opposite sides of each partition may be formed as a single flat plane, with the other side being a stepped composite plane composed of two flat regions and a shoulder, the shoulder being formed generally at a middle height of the partition so as to continue to both the flat regions. In harmony with such asymmetrical sides of each partition, each cutout may also have a single flat plane as its one side and a stepped composite plane as its other side asymmetrical with the one side.

Also preferably, a latching mechanism may be provided in the pair of connectors in order to keep them in a stable engagement with each other. In an example, the male housing has an elastic lock arm that protrudes from each of its opposite outer sides, and a detent protrudes sideways from a middle portion of the lock arm. The female housing has a pawl formed in an inner surface of each of its opposite outer side walls, so that the detent and pawl catching one another do constitute the latching mechanism.

THE PREFERRED EMBODIMENTS

Figure 1:
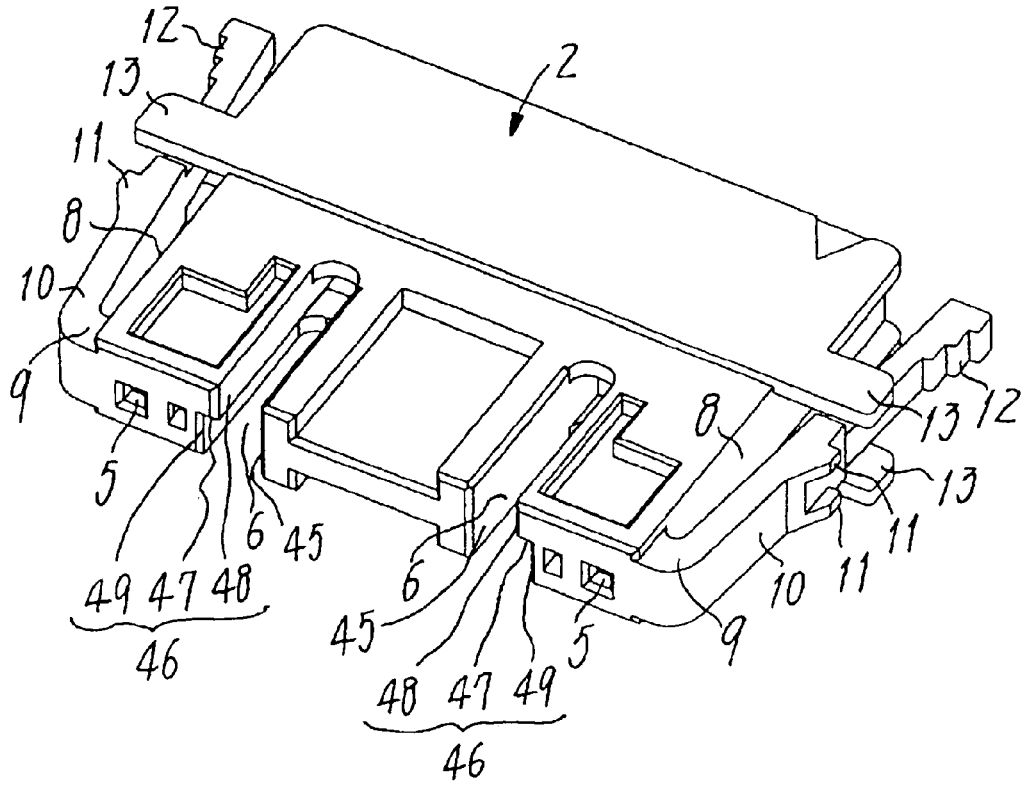
FIG. 1 is a perspective view of a connector housing formed as a principal part of the male connector (viz., a socket connector) that is provided herein.

Now some embodiments of the present invention will be described referring to the drawings.

Figure 2:
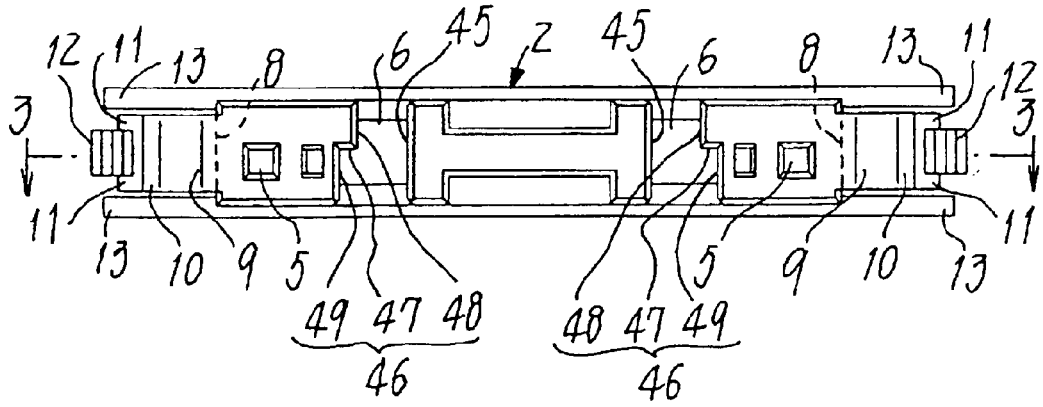
FIG. 2 is a front elevation of the connector housing shown in FIG. 1.
Figure 3:
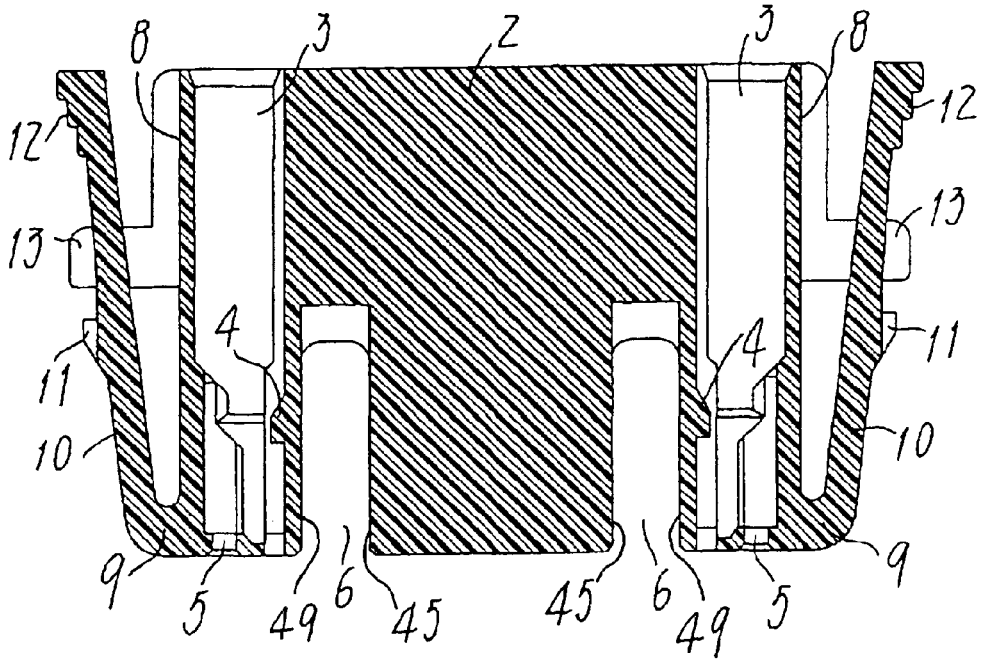
FIG. 3 is a cross section taken along the line 3—3 in FIG. 2.
Figure 4:
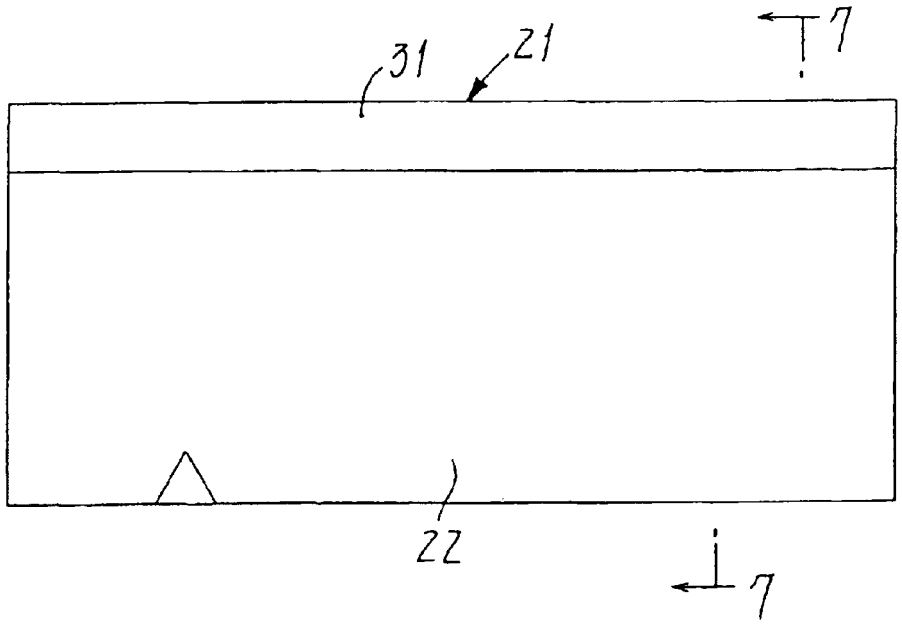
FIG. 4 is a perspective view of another connector housing formed as a principal part of the female connector (viz., a base connector) that also is provided herein.
Figure 5:
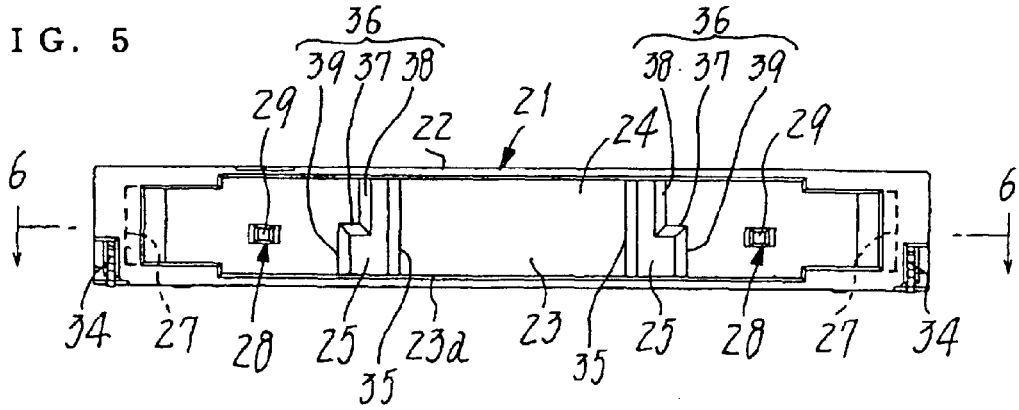
FIG. 5 is a front elevation of the connector housing shown in FIG. 4.
Figure 6:
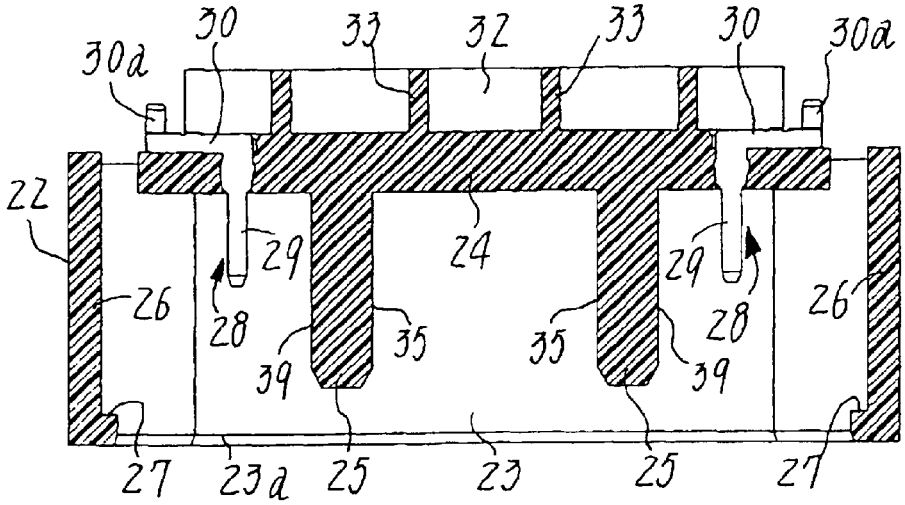
FIG. 6 is a cross section taken along the line 6—6 in FIG. 5.
Figure 7:
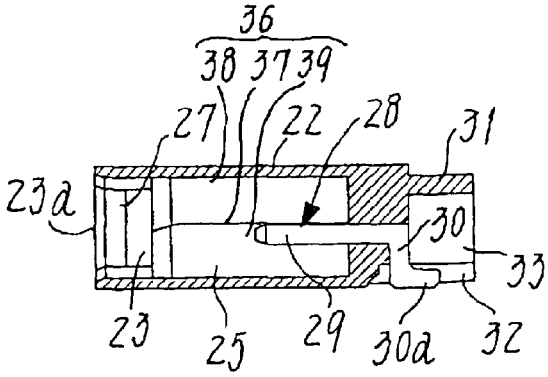
FIG. 7 is a cross section taken along the line 7—7 in FIG. 4.
Figure 8:
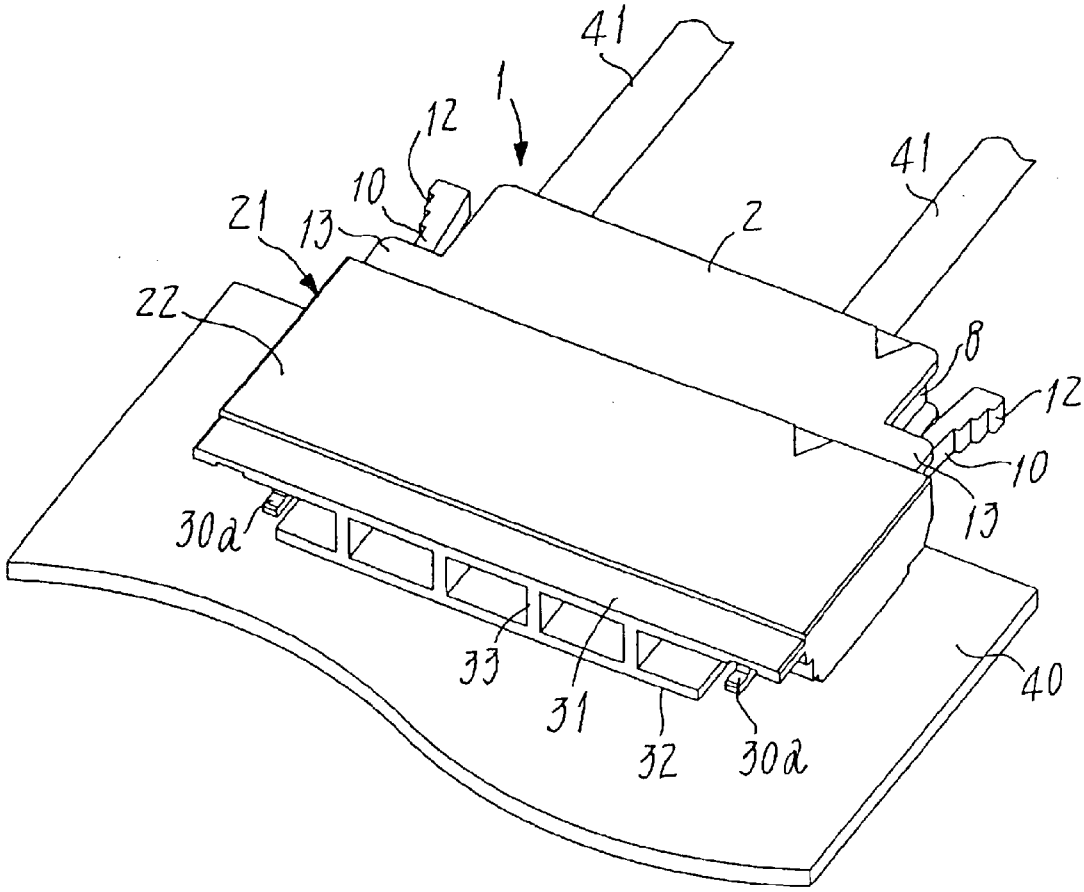
FIG. 8 is a perspective view of the male connector having fitted in the female connector.
Figure 9:
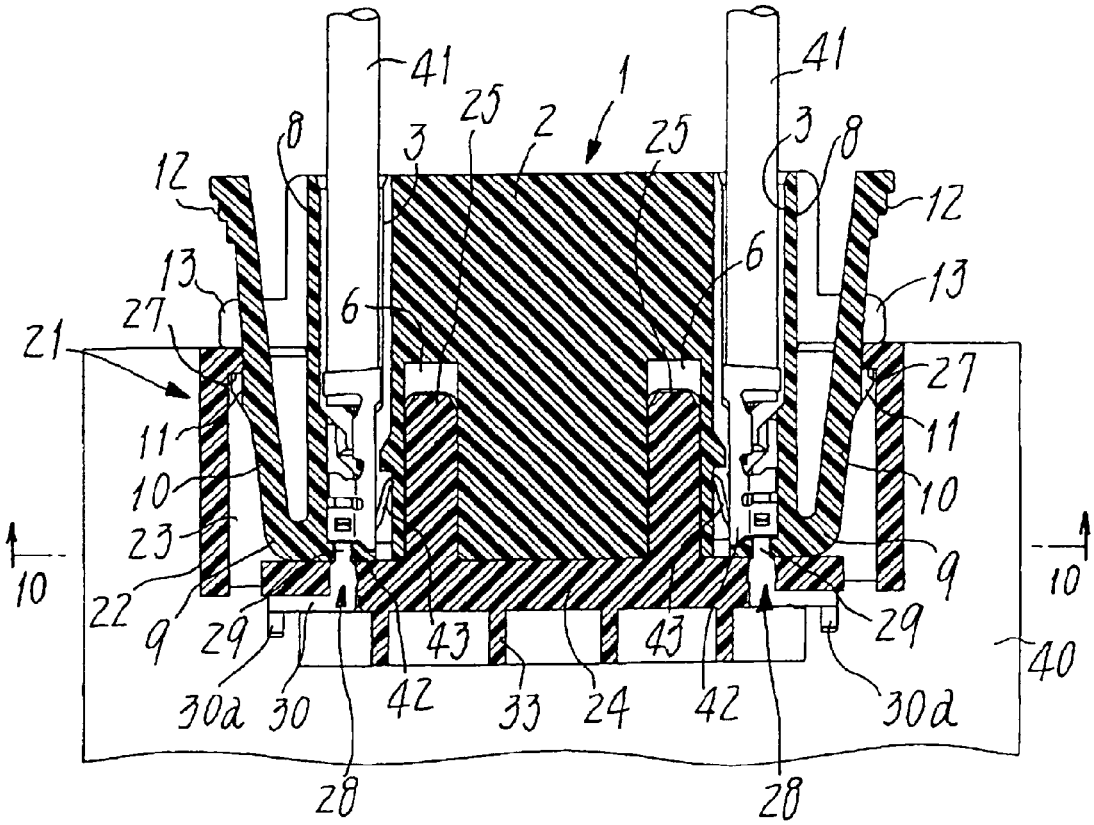
FIG. 9 is a horizontal cross section of the connectors mating one another as shown in FIG. 8.

FIGS. 1 to 3 show a socket housing (as a male housing) 2 as one of the principal parts of a socket connector (as a male connector) 1, also referred to in FIGS. 8 and 9. The socket housing 2 is made of an insulating plastics to be generally of a parallelepiped shape depressed in contour and elongate sideways. Two compartments 3 are formed in parallel with each other and in opposite side regions of the socket housing 2, so that socket contacts 42 (see FIG. 9) crimped on wire ends 41 are secured in the respective compartments 3. As seen in the drawings, the two compartments 3 are spaced a noticeable distance in order to afford sufficient spatial and linear distances between the socket contacts 42. An inner wall of each compartment has a lug 4 protruding sideways therefrom to engage a lance 43 of the socket contact 42 so as to hold it in place. A front wall of each compartment 3 has a hole 5 formed therein, and one of pin contacts 28 held in a base connector 21 as the female connector in the invention will be inserted into this hole. Two cutouts 6 engraved in the socket housing 2 and located adjacent to the respective compartments 3 do extend from the front face to a middle portion of this housing. These cutouts 6 lie in a direction in which a mating base connector 21 will be urged to fit on the mating socket connector. A base housing (as a female housing) 22 of base connector 21 has partitions 25 formed integral therewith to fit in the respective cutouts 6. These cutouts 6 and partitions 25 will cooperate with each other, lest each of said connectors 1 and 21 should be reversed upside down when engaging one another, as will be detailed below.

Elastic ears 9 continuing from fore corners of socket housing 2 do protrude outwards and sideways from the opposite sides 8 of this housing. A pair of lock arms 10 continue rearwards from the respective ears 9 so as to extend a full length from fore to rear and obliquely outwards. Each lock arm 10 is of a width smaller than the height (viz., thickness) of housing 2, and a detent 11 protruding outwards and sideways is formed in a middle portion of each lock arm. A rear portion extending from this middle portion of lock arm 10 serves as a push lever 12 useful to elastically and temporarily deform the lock arm inwardly. A pair of guards 13 protect opposite sides of each lock arm, at its portion located behind the detent 11 and intervening between the guards. Any foreign wire ends or the like will be prevented by these guards 13 from catching the lock arms 10, also enabling visual inspection and/or confirmation of the engagement of this socket connector with the mating base connector 21.

FIGS. 4 to 7 show the base connector 21 as the female connector in this invention. The base housing (i.e., female housing) 22 of this connector is of a depressed box-like shape having a front opening. A cavity 23 formed in this base housing is for insertion of the socket housing 2 of mating connector 1 and the fore portions of lock arms 10. Two partitions 25 formed integral with and protruding forwards from a rear wall 24 defining the cavity 23 are for insertion into the cutouts 6 of said mating connector 1, in the above-mentioned direction in which the connector 21 is urged to mate with it as mentioned above. Inner wall surfaces 26 also defining the cavity 23 have fore ends formed integral with pawls 27 for engagement with the detents 11 of lock arms 10. Pin contacts 28 penetrate the rear wall 24 so as to be fixed therethrough and outside the respective partitions 25. Contacting portions 29 of these pins 28 protrude forward towards the front opening 23*a*, within the cavity and along the housing's 22 center line, that lies in parallel the above-mentioned direction. On the other hand, lead portions 30 of those contacts 28 protrude rearwards from said wall 24 are bent at first sideways and outwards in opposite directions away from each other, and subsequently bent again to respectively assume an L-shaped solderable end 30*a*. Rear extensions 31 and 32 are projected from an upper and lower edges of the rear wall 24. Several webs 33 connecting these extensions one to another are intended to increase the linear and spatial distance by which the pin contacts' lead portions 30 are spaced one from another. Thus, the present connector assembly is improved in its resistance to high voltages that would cause some problems. In the drawings, the reference numeral 34 denotes reinforcement metals attached to the fore and outer surfaces of side walls of this base housing 22.

As already discussed above, the partitions 25 of base housing (i.e., female housing) 22 have to cooperate with the corresponding cutouts 6 of socket housing (i.e., male housing) 2 in order to prevent any reversed engagement of these housings one with another. Therefore, opposite sides 35 and 36 of each partition 25 have their surfaces shaped asymmetrical about the cross-sectional center of it. In detail, one of the opposite sides 35 is a single and uniform flat plane, whilst the other side 36 is a composite plane comprising two flat regions 38 and 39. A shoulder 37 intervenes between these regions and connects them one to another, such that a distance defined between the flat plane 35 and one of the flat regions 39 is remarkably larger than that defined between the flat plane 35 and the other flat regions 38. In harmony with such a configuration of each partition, each cutout 6 in the socket housing has opposite wall surfaces 45 and 46 that are not symmetrical planes as seen in FIGS. 1 and 2. Similarly to the partitions, one of those wall surfaces 45 is a single flat plane corresponding to that 35 of each partition 25. The other wall surface 46 is a composite plane comprising two flat regions 48 and 49. A shoulder 47 intervenes between these regions and connects them one to another, such that a distance defined between the flat plane 45 and one of the flat regions 49 is likewise remarkably larger than that defined between the flat plane 45 and the other flat regions 48.

It will be understood that configurations of opposite sides 35 and 36 of each partition 25 as well as configurations of opposite sides 45 and 46 of each cutout 6 are not restricted herein to those described above. It is possible to alternatively employ any other combination of planes asymmetrical about the cross-sectional center of each partition 25.

Figure 10:
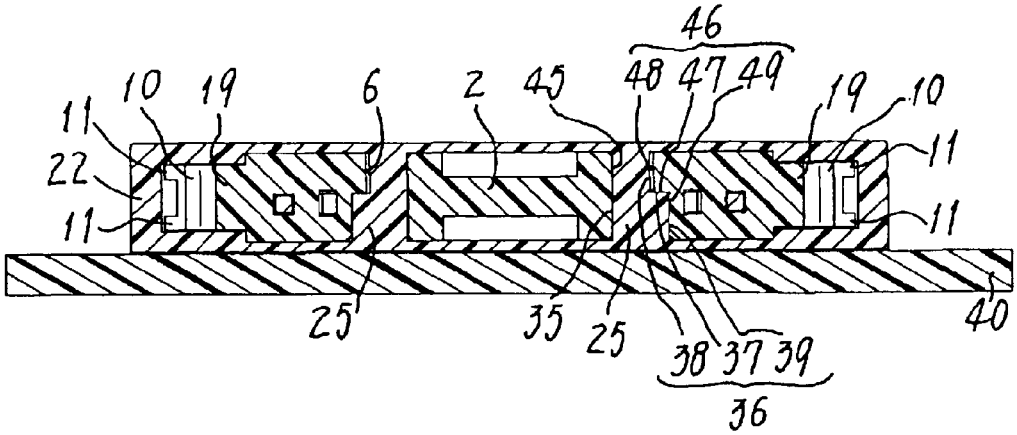
FIG. 10 is a cross section taken along the line 10—10 in FIG. 9.

In operation, the socket and base connectors 1 and 21 described above will be made fit one in another as seen in FIGS. 8 to 10. In detail, and as discussed above, the socket connector 1 has the socket contacts 42 each crimped on the wire end 41 and placed in the compartment 3 of socket housing 2, in such a state that its lance 43 bears against the lug 4. On the other hand, the solderable end 30*a* of each pin contact 28 as well as both the reinforcement metals 34 are soldered to a printed circuit board 40 in the surface-mounting fashion.

The socket housing body 2 and the lock arms 10 will be inserted into the cavity 23 through the front opening 23*a* of base housing 22. As seen best in FIGS. 9 and 10, one of opposite side walls 45 of each cutout 6 of housing 2 is a flat plane to be guided inwards along the flat side 35 of corresponding partition 25. Thus, the shoulder 47 and both the side planes 48 and 49 of the composite other side wall 46 are brought into contact with the corresponding shoulder 37 and both the side planes 38 and 39 of the composite other side 36 of partition 25. Simultaneously and consequently with this process, the contacting portions 29 of pin contacts 28 enter the compartments 3 through the holes 3 so as to engage with and establish an electric connection with the respective socket contacts 42. Also consequently, the lock arms 10 will be inserted, causing themselves to make elastic inward deformation towards the opposite sides 8 of socket housing 2. As this housing 2 is further pushed together with its lock arms 10 into the base housing and towards a final position, the detents 11 of said arms will ride across the lateral edges of front opening 23*a* and advance deeply into the cavity 23. Then, the lock arms 10 will spring back to cause their detents 11 to come into a clicking engagement with the pawls 27 of base housing 22, thereby firmly fixing the socket housing 2 in the base housing. At the same time as these final motions of the parts noted above, the guards 13 of socket housing 2 collide with and bear against the front face of base housing 22. Such a contact of guards 13 with said face enables visual confirmation of correct ultimate position of those connectors 1 and 21. In this state of the members, the detents 11 of lock arms 10 are latched by the pawls 27 within the cavity 23 of base housing 22. By virtue of this feature, any external force will scarcely unlock those detents 11 off the pawls 27. In addition, the guards 13 will protect each arm 10 intervening between them from a possibility that any foreign article would unintentionally attack it.

When the socket connector 1 is to be released from the base connector 21, any user or operator may use his or her fingers to press the push levers 12 of lock arms 10 towards each other. The lock arms thus elastically deformed towards the opposite sides 8 will unlock the detents 11 from pawls 27, allowing the user or operator gripping the lock arms 10 to pull back them in order to remove the socket housing 2 out of the base housing 2.

The socket housing 2 of socket connector 1 reversed upside down might erroneously be forced a small distance into the base connector 21. In such an event, the shoulders 47 in cutouts 6 will collide with the front faces of wider portions (formed between the flat side 35 and flat region 39) of the partitions 25. Thus, the socket housing 2 will not be able to inwardly advance any more, surely avoiding wrong connection of the complementary housings.

In summary, the opposite sides of each partition formed in the cavity of female connector housing are asymmetrical planes, with the opposite sides of each cutout formed in the male connector housing provided herein to engage the partition being also asymmetrical planes. Thanks to this structural feature, any special, excessive or additional space is no longer required in avoiding 'mal-connection' of these housings. The pair of such irreversible complementary connectors may particularly be adapted for use as the high-voltage type connectors that should be made as small and as thin as possible.

The latching mechanism for interlocking those connector housings is built in the female housing and disposed in its cavity as just referred to above and defined in the accompanying claim 3. This structure will not only contribute to reduction in spatial size of the pair of connectors, but also will surely prevent any wrong or upside-down connection and effectively stabilize the correct mutual connection of their housings.

What is claimed is:

1. A pair of irreversible complementary connectors, one of them being a female connector, with the other being a male connector, a female housing of the female connector having a cavity with a front opening, the male connector comprising a male housing, the cavity fitting on the male housing along an insertion direction thereof, the female housing having a plurality of pin contacts accommodated in the cavity, as well as two partitions formed therein along the insertion direction so that one of the pin contacts is separated from the other, a plurality of socket contacts engaging with the pin contacts and accommodated in the male housing, and the male housing having two cutouts respectively fitting on the plurality of partitions, wherein each partition has opposite sides asymmetrical about a cross-sectional center of the partition, and each cutout also has opposite sides formed asymmetrical corresponding to the sides of each partition, such that the connectors are inhibited from engaging one another if one of them is reversed upside down relative to the other.

2. A pair of irreversible complementary connectors as defined in claim 1, wherein one of the opposite sides of each partition is formed as a single flat plane, with the other side being a stepped composite plane composed of two flat regions and a shoulder, the shoulder being formed generally at a middle height of the partition so as to continue to both the flat regions, and wherein each cutout has a single flat plane as its one side and a stepped composite plane as its other side asymmetrical with the one side, in a fashion in harmony with the corresponding each partition.

3. A pair of irreversible complementary connectors as defined in claim 1, further comprising a latching mechanism for keeping the connectors in a stable engagement with each other, the mechanism being composed of an elastic lock arm that protrudes from each of opposite outer sides of the male housing, a detent protruding sideways from the lock arm, and a pawl formed in an inner surface of each of opposite outer side walls of each cutout of the female housing so that the detent and pawl catching one another do constitute the latching mechanism.

4. A pair of irreversible complementary connectors as defined in claim 1, wherein the female housing has two pin contacts, and the male housing has two socket contacts engaging with the two pin contacts to conduct high voltage currents.

* * * * *